US008689474B2

(12) United States Patent
Garfinkle

(10) Patent No.: US 8,689,474 B2
(45) Date of Patent: Apr. 8, 2014

(54) MULTI-PART SIGNAGE

(76) Inventor: Benjamin L. Garfinkle, Piedmont, CA (US)

( * ) Notice: Subject to any disclaimer, the term of this patent is extended or adjusted under 35 U.S.C. 154(b) by 1160 days.

(21) Appl. No.: 12/035,156

(22) Filed: Feb. 21, 2008

(65) Prior Publication Data

US 2009/0211135 A1 Aug. 27, 2009

(51) Int. Cl.
*G09F 7/02* (2006.01)

(52) U.S. Cl.
USPC ..... 40/618; 40/611.05; 40/611.08

(58) Field of Classification Search
USPC ..... 40/605, 611.05–611.07, 611.09, 617, 40/618
See application file for complete search history.

(56) References Cited

U.S. PATENT DOCUMENTS

| | | | | | |
|---|---|---|---|---|---|
| 4,344,244 | A * | 8/1982 | Tyke | 40/611.05 |
| 4,604,820 | A * | 8/1986 | Edman | 40/605 |
| 4,698,928 | A * | 10/1987 | Soporowski | 40/651 |
| 4,884,351 | A * | 12/1989 | Abramson | 40/611.05 |
| 5,588,238 | A * | 12/1996 | Visocky et al. | 40/618 |
| 5,930,926 | A * | 8/1999 | Kaplan | 40/611.08 |
| 6,890,180 | B2 * | 5/2005 | Sterns et al. | 434/157 |

* cited by examiner

*Primary Examiner* — Casandra Davis
(74) *Attorney, Agent, or Firm* — Bay Area Technology Law Group PC

(57) ABSTRACT

A sign for displaying product information to a consumer. The sign includes first and second components for supporting primary and secondary product information. A first support member is provided for supporting the sign in an orientation to enable the product information to be visible to a consumer. A connecting interface is provided in the form of extenders emanating from the first and second components enabling the first and second components to releaseably attach to one another, the second component used for supporting supplemental product information in an orientation to enable supplemental product information to be made visible to a consumer.

2 Claims, 2 Drawing Sheets

MULTI-PART SIGNAGE

TECHNICAL FIELD

The present invention is directed to a two part sign holder device to provide primary and supplemental signage when needed. When not needed, primary or secondary signage alone can be employed to minimize the signage "footprint."

BACKGROUND OF THE INVENTION

Retail establishments such as supermarkets require signage of every imaginable configuration. Every product sold requires some type of sign to inform a consumer of its nature and price. Messaging can be as simple as providing a consumer with the name or identity of the item being sold and its price. However, the growing complexity of food offerings oftentimes requires differentiating one product from another, such as one being "organic" or "wild" or "farm raised." It is also quite routine to indicate the product's country of origin, to indicate that the product is on sale at a promotional price or otherwise provide product differentiation in order to encourage its purchase.

If a single sign was to be created for all possible messaging including product identification, price, point of origin, promotional information and health and nutritional benefits, the sign could potentially be quite large. If a single sign was used having universal applicability, when secondary indicia was not part of the messaging, a good portion of the sign would be blank and unappealing.

It is thus an object of the present invention to provide signage which when only primary information is to be conveyed, such as product identification and price, a relatively small "footprint" is employed while when additional or supplemental information is to be conveyed, primary and supplemental signage can be joined in order to convey such additional information.

SUMMARY OF THE INVENTION

A sign for displaying product information to a consumer. The sign includes first and second components for supporting primary and secondary product information. A first support member is provided for supporting the sign in an orientation to enable the product information to be visible to a consumer. A connecting interface is provided in the form of extenders emanating from the first and second components enabling the first and second components to releaseably attach to one another, the second component used for supporting supplemental product information in an orientation to enable supplemental product information to be made visible to a consumer.

DETAILED DESCRIPTION OF THE INVENTION

It is generally the goal of the present invention to provide signage for use in supermarkets and similar retail environments that has the flexibility to provide just the amount of messaging necessary to inform a consumer of what the retailer intends to convey without including fields which might otherwise be blank when not being employed. In this regard, reference is made to FIG. 1.

Figure 1:
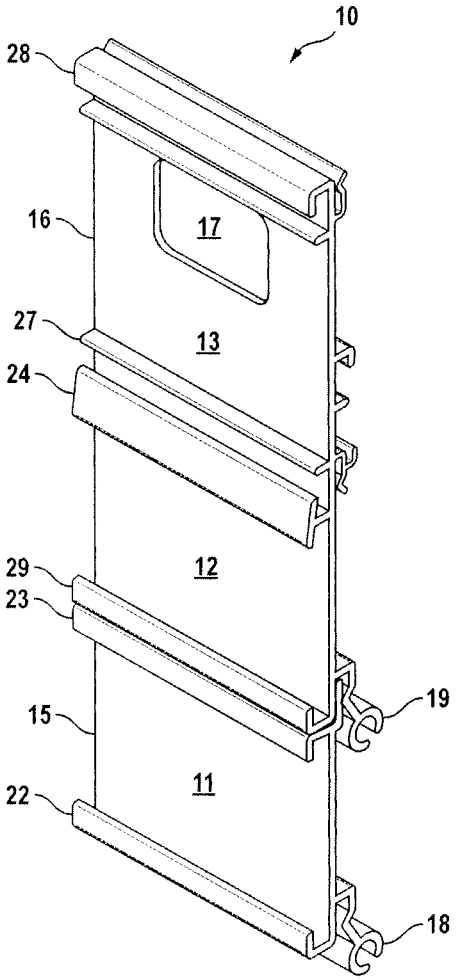
FIG. 1 is a perspective view of the sign of the present invention.

In turning to FIG. 1, it is noted that sign 10 is composed of two sign subparts, namely, first component 16 and second component 15. First component 16 could be used alone by simply attaching support member 19 of any suitable configuration to enable it to append to a suitable fixture enabling any messaging contained within regions 12 and 13 to be visible to a consumer, preferably by orienting first component 16 in a substantially vertical orientation.

Support member 19 is depicted as a C-shaped member simply as an illustration of one of the myriad of support and connecting elements engageable with preexisting support structures. Such structures include commonly employed moldings as well as pan clips for bowls, bases or further attachments which, themselves, connect to typical moldings found in refrigerated cases and at the edges of grocery store shelves.

Figure 2:
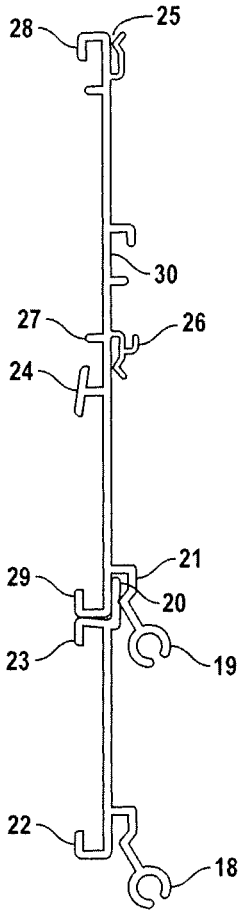
FIG. 2 is a side view of the sign of FIG. 1.
Figure 3A:
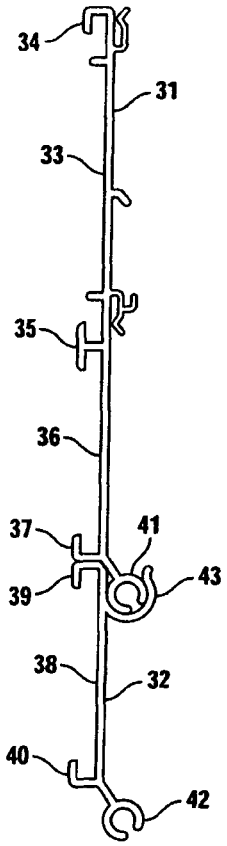
FIG. 3A is a side view of another embodiment to the present invention.
Figure 3B:
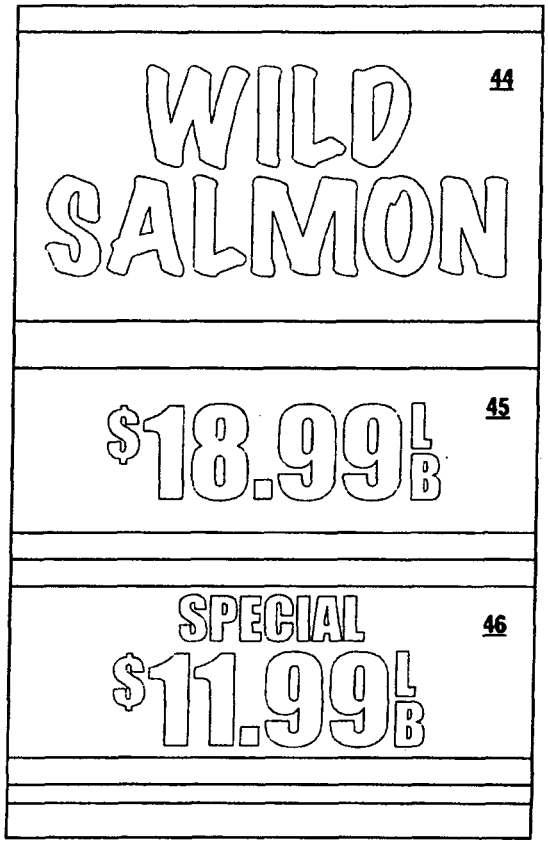
FIG. 3B is a front view of the embodiment of FIG. 3A showing typical signage which would be displayed thereon.

When employed alone, first component 16 is intended to support and display primary product information such as depicted in fields 44 and 45 of FIG. 3B. Typically, regions 12 and 13 and corresponding regions 33 and 36 of FIG. 3A are planar supporting suitable signage between lips 24/28/29 of FIGS. 1 and 2 and lips 34/35/37 of FIG. 3A. In this instance, first component displays primary signage indicating to a customer that wild salmon is being offered at $18.99 per pound.

It is oftentimes desirable to provide information related to a product on the back side of a sign to enable a counter clerk to see certain product information without having to remove the sign or otherwise turn in it his or her direction to read its front face. Not only could product information be releaseably appended to the back of the sign through the use of, for example, clip 26, but product signage, when placed in planar region 13, can be printed with pertinent information on its back side so once slipped between lips 24 and 28, could be read through open window 17.

As noted above, there are times when simple signage of the type to be supported in planar regions 12/13 and 33/36 is not sufficient to complete the messaging that the retailer wishes to convey. When this is the case, second component 15 is used with first component 16. When employed together, it is the intent to provide a connecting interface comprised of extenders emanating from first and second components 16/15, enabling the first and second components to releaseably attach to one another.

Any suitable connecting interface can be created noting that the embodiments of FIGS. 1 and 3A are presented for illustrative purposes. Turning to the embodiment of FIGS. 1 and 2, it is shown that vertical extender 20 is frictionally captured by molded feature 21 acting further as a support leg for first support member 19. When employed, first support member 19 will not necessarily be needed to support the overall composite sign 10 and, thus, secondary support member 18 is provided having the same interface feature as support member 19 to simply operate in the environment previously occupied solely by first component 16.

In the embodiment shown in FIG. 3A, first support member 41 can be captured by female molding feature 43 thus obviating the need for a separate feature such as vertically extending member 20 shown in FIG. 2. When thus employed, first component 31 and second component 32 are joined to create a substantially planar sign supported, substantially vertically, by suitable support molding through the use of second support member 42. Secondary product information is thus provided in planar field 38 by slipping product signage between lips 39 and 40, in this illustration, indicating that the wild salmon has been reduced in price from $18.99 per pound to $11.99 per pound.

In summary, a typical retailer would begin promoting a product by presenting simple messaging adequately supported and displayed in planar regions 13/12 and 33/36. Typically, identification of the product would be in the upper planar regions 13/33 and the price for the product provided in planar regions 12/36. If, at a later time, the retailer wishes to add additional signage indicating, for example, the product is being sold as "organic" or "fresh" or "wild" vs. "farm raised" or being offered at a special promotional price, first component 16/31 would be joined to second component 15/32 and support members 19/41 would be disengaged from suitable supporting structures and replaced by releaseably engaging second supporting members 18/42 to create a unitary sign having more area(s) available for this additional messaging. In addition, channel 25 is provided to receive yet additional signage slid therein known in the trade as a "topper."

Additional features can be placed on the back side of first component 16 for any of a multitude of reasons. For example, information which a sales person may deem important could be slid within clip 26 and held releaseably by friction and made visible only the back side of the signage. Such additional information could provide a clerk with "sell by" or "pull" dates when product, particularly perishable product, should be removed or rearranged on a shelf to insure quality and freshness.

What is claimed is:

1. A sign for displaying product information to a consumer, said sign comprising first and second components for supporting primary and secondary product information, a connecting interface comprised of an extender and molded feature enabling said first and second components to releaseably attach to one another, the first component provided for supporting primary product information and the second component provided for supporting supplemental product information creating a unitary sign in an orientation to enable said product information to be visible to a consumer and a support member emanating from said first component and a support member emanating from said second components each supporting said first and second components respectively in an orientation to enable said product information to be made visible to a consumer.

2. A sign for displaying product information to a consumer, said sign comprising first and second components for supporting primary and secondary product information, a first support member for supporting said sign in an orientation to enable said product information to be visible to a consumer, a connecting interface comprised of an extender and molded feature enabling said first and second components to releaseably attach to one another, said second component provided for supporting supplemental product information in an orientation to enable said supplemental product information to be made visible to a consumer;

wherein when said first and second components are engaged by joining a support member from one of said first and second components to said connecting interface.

* * * * *